US008235243B2

(12) United States Patent
Illesi

(10) Patent No.: US 8,235,243 B2
(45) Date of Patent: Aug. 7, 2012

(54) TANK FOR HIGH PRESSURE FLUIDS

(75) Inventor: Matteo Hee Seung Illesi, Via Castelletto (IT)

(73) Assignee: IHP Composite S.R.L., Borgo Valsugana TN (IT)

( * ) Notice: Subject to any disclaimer, the term of this patent is extended or adjusted under 35 U.S.C. 154(b) by 778 days.

(21) Appl. No.: 12/293,733

(22) PCT Filed: Mar. 20, 2007

(86) PCT No.: PCT/IB2007/000691

§ 371 (c)(1),
(2), (4) Date: Nov. 11, 2008

(87) PCT Pub. No.: WO2007/107851

PCT Pub. Date: Sep. 27, 2007

(65) Prior Publication Data

US 2010/0230422 A1 Sep. 16, 2010

(30) Foreign Application Priority Data

Mar. 21, 2006 (IT) ..... VI2006A0078

(51) Int. Cl.
*F17C 1/04* (2006.01)
*F17C 1/00* (2006.01)

(52) U.S. Cl. ..... 220/584; 220/588

(58) Field of Classification Search ..... 206/0.6; 220/581, 4.01, 62.19, 584, 588, 586, 203.19, 220/203.01, 678, 677, 661, 601, 4.14, 4.13, 220/4.12; D9/564, 474, 574; *F17C 1/16, F17C 1/04, 1/02*

See application file for complete search history.

(56) References Cited

U.S. PATENT DOCUMENTS

| | | | | | |
|---|---|---|---|---|---|
| 64,123 | A | * | 4/1867 | McGarry | 220/562 |
| 234,473 | A | * | 11/1880 | Hayden | 220/592.19 |
| 868,548 | A | * | 10/1907 | Griffin | 220/587 |
| 1,130,988 | A | * | 3/1915 | Lape | 220/567.2 |
| 2,102,124 | A | * | 12/1937 | Lithgow | 220/562 |
| 2,268,961 | A | * | 1/1942 | Raymond et al. | 220/588 |
| 2,834,702 | A | * | 5/1958 | Gibb | 220/562 |
| 2,868,368 | A | * | 1/1959 | Beach | 206/319 |
| 3,508,677 | A | * | 4/1970 | Laibson et al. | 220/590 |
| 4,619,374 | A | * | 10/1986 | Yavorsky | 220/62.19 |

(Continued)

FOREIGN PATENT DOCUMENTS

DE 197 49 950 A1 5/1999

(Continued)

OTHER PUBLICATIONS

International Search Report re application No. PCT/IB2007/000691, dated Jan. 10, 2008.
Written Opinion re application No. PCT/IB2007/000691, dated Jan. 10, 2008.

*Primary Examiner* — Mickey Yu
*Assistant Examiner* — Robert J Hicks
(74) *Attorney, Agent, or Firm* — Husch Blackwell LLP

(57) ABSTRACT

The present invention is a tank suitable to contain high pressure fluids, especially for compressed natural gas used for automotive purposes. The tank has a discoid shape to be easily placed on board of vehicles. The tank comprises a sealed internal core and an external coating made through a twisted coats fiber wrapping of composite material with a very high mechanical tensile resistance. According to some executive variants, the tank internally comprises a reinforcing structure made up of a plurality of elements welded in contact with the internal surface of the core.

11 Claims, 7 Drawing Sheets

U.S. PATENT DOCUMENTS

| | | | | |
|---|---|---|---|---|
| 4,685,589 | A * | 8/1987 | Benton | 220/661 |
| 5,105,996 | A * | 4/1992 | Freeland et al. | 222/464.1 |
| 2002/0053573 | A1 | 5/2002 | Bowen et al. | |
| 2003/0183638 | A1 | 10/2003 | Minta et al. | |
| 2004/0026431 | A1 * | 2/2004 | Jones | 220/588 |
| 2005/0011891 | A1 * | 1/2005 | Austerhoff et al. | 220/4.12 |
| 2007/0246462 | A1 * | 10/2007 | Shearin | 220/4.13 |

FOREIGN PATENT DOCUMENTS

| | | | |
|---|---|---|---|
| FR | 1554072 | | 1/1969 |
| WO | WO 00/57102 | A1 | 9/2000 |
| WO | WO 01/48418 | A2 | 7/2001 |
| WO | WO 2004/072542 | A1 | 8/2004 |
| WO | WO 2004/096459 | A1 | 11/2004 |

* cited by examiner

TANK FOR HIGH PRESSURE FLUIDS

BACKGROUND OF THE INVENTION

The present invention is referred to a tank suitable to contain high pressure fluids, typically for compressed natural gas (CNG) for automotive purposes, which tank has a bombé disc shape particularly suitable for on board vehicles installation.

It is known that the current production of high pressure compressed natural gas tanks exclusively consists of the so-called "cylinders", steel made by different manufacturing processes.

These cylinders present a cylindrical shape, mainly lengthened and tapered at the two ends.

The use of the above mentioned type of cylinders in the automotive field with compressed natural gas, is till today rather limited, and this especially because of the weight and the dimensions of the cylinders themselves, these characteristics being absolutely necessary to have a satisfying route autonomy, before the subsequent refuelling.

The attempts to reduce weight and dimensions of the cylinders themselves are anyway contrasted by the necessity to comply with the actual regulations in force which are inspired to absolutely safety criterions.

During the last years it has been started the production of CNG high pressure cylinders for automotive purposes which include and internal core (said also liner) in different materials and covered by composite materials soaked with appropriates resins.

The function of the coating is to supply to the cylinder the necessary resistance to support the high pressures of the gas, which cannot be supported by the inside core, also of reduced thickness.

For safety reasons, the main international rules, referred to compressed natural gas cylinders for automotive purposes (CNG automotive purposes), such as ISO11439, NGV2, R110, basically identify four types of containers, respectively named:

TYPE 1: cylinder fully made of steel;

TYPE 2: liner made of steel or aluminium reinforced by fiber filament in its cylindrical part;

TYPE 3: steel or aluminium liner reinforced by fiber filament on all its surface;

TYPE 4: cylinders fully made by composite material;

TYPE 5: other possible types of manufacture, not included in types from 1 to 4.

SUMMARY OF THE INVENTION

The present invention intends, with respect to the above mentioned regulations, to put together in one only object both the advantages obtained with the cylinders of most recent conception, absolutely safe but much lighter than the traditional ones, and those of a more suitable shape to be put mainly on vehicle board.

The declared purpose is obtained by the production of a tank for high pressure fluids, especially for compressed gases for automotive purposes, which, according to the content of the first claim, is characterised in that it has a solid discoid shape, particularly suitable to be put with a reduced dimension on board of vehicles using compressed natural gas (CNG) for automotive purposes.

It is specified that for solid of discoid shape it is intended a revolution solid generated by the rotation around one of the symmetry axis of an essentially elliptical figure and with minor axis equal or shorter than half of the major axis. This tank includes a sealed core, also with reduced thickness, in case reinforced by means of a proper structure, and an external coating formed by a fiber wrapping of composite material with a very high mechanical tensile resistance.

According to the invention characteristics, the so produced tank has a very flat shape and, therefore, it is easy to be placed into the luggage van of the car, preferably in a lowering part of the same properly made.

In addition, the internal core wrapping made by means of a binding fiber resin soaked allows to maintain unchanged all the safety limits imposed by the rules to avoid the burst of the high pressure tank.

It is noted that the production range of the invention tank can cover the storage and the use field of different compressed gases, typically natural gas for automotive purposes with 200 bar working pressures, 300 bar testing pressures and over 450 bar bursting pressures.

The tank object of the present invention is advantageously used in mechanical sectors requiring the use of fluids containers subjected to high working pressures, even over 450 bar.

BRIEF DESCRIPTION OF THE DRAWINGS

The following description is referred to the figures of the enclosed drawings, where.

DESCRIPTION OF THE INVENTION

The tank object of the present invention has been designed to be mainly installed on board of the existing vehicles, in the spare wheel hollow, or, in any case, in a similar hollow easily obtainable in the new production vehicles.

Figure 1:
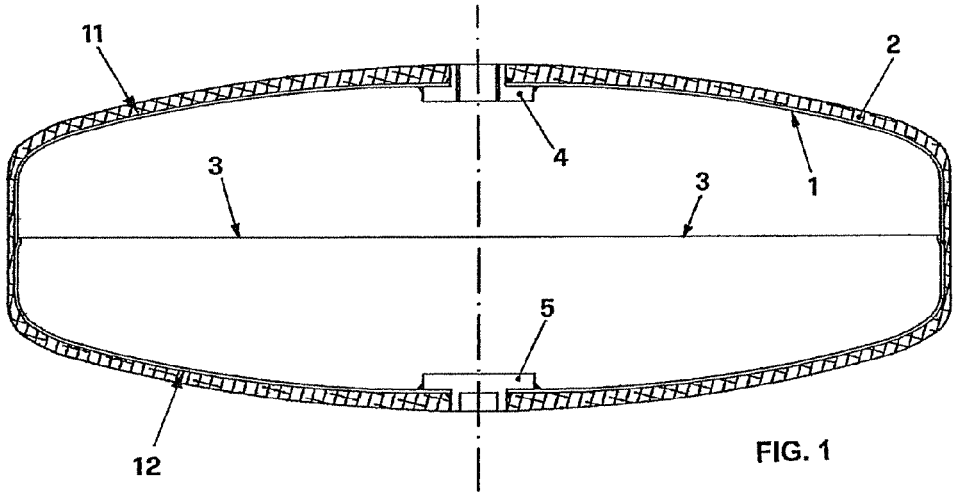
FIG. 1 shows in median section one shape of the tank of the invention.
Figure 2:
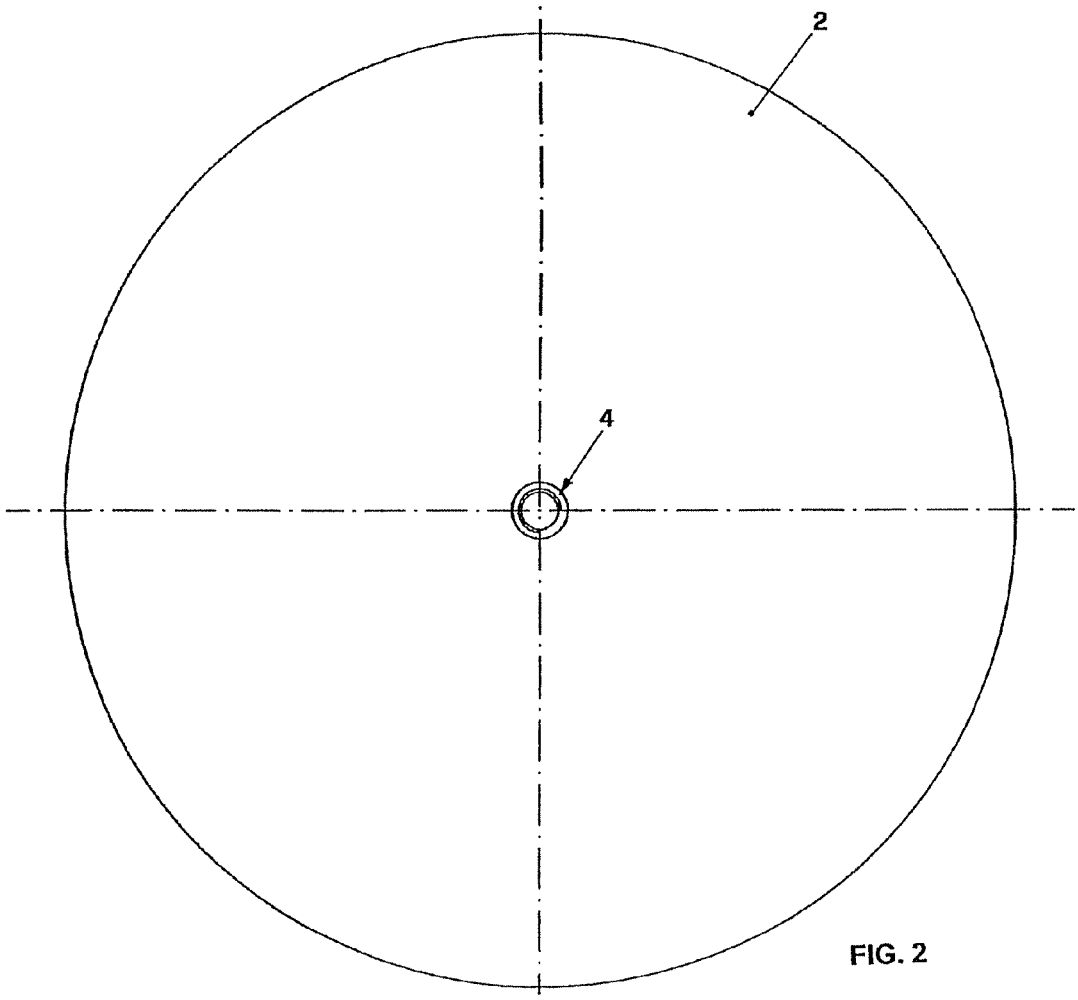
FIG. 2 shows the tank of FIG. 1 in a plan view.

Its shape of a bombé disc, indicatively shown in FIGS. 1 and 2, is in fact an essentially flat discoid shape that is ideally suitable to the purpose, similarly to what happens with the LPG (liquefied petroleum gas) toroidal tanks.

The tightness and resistance problem of the tanks of high pressure storage of natural gas (requirements imposed by the rules in force), together with the considerable reduction of their weight with respect to that of the traditional steel cylinders with proper thickness, is solved by the present invention thanks to the composition shown in the above cited figures.

The tank essentially includes the sealed core 1, even with thin thickness, and the external coating 2 made by a fiber wrapping of composite material with a very high mechanical tensile resistance.

The internal core 1 is formed by two facing halves 11 and 12, mutually joined along the contact circumference 3 by welding.

The two halves 11 and 12 are mainly made by metallic material. It is preferred to usually use stainless steel or aluminum.

In tanks with small diametrical dimensions, the two halves themselves, as in case of the example of FIG. 1, are realized without any reinforcing structure, nor external or internal.

Said internal core 1 presents a first central element 4 for the inlet and the outlet of the fluid to be used and a second central element 5 supporting the tank to coaxially placed on the opposite side of said first central element 4.

This second central element 5 has, first of all, the purpose of supporting the internal core 1 during the manufacturing process of the external coating 2 of the invented tank.

In this case it is pointed out that the external coating is, more exactly, a wrapping that completely covers the internal core 1.

It is made by preferably using the carbon fiber wrapped in several coats twisted on the same internal core, by means of equipment known per sé.

The fiber wrapping is soaked by polyester or epoxy resins suitable to give compactness and steadiness to said external coating.

This coating results with very reduced weight and dimensions and however it presents a very high resistance to the solicitations caused by internal pressure. This characteristic allows the safe use of the invented tank.

Figure 3:
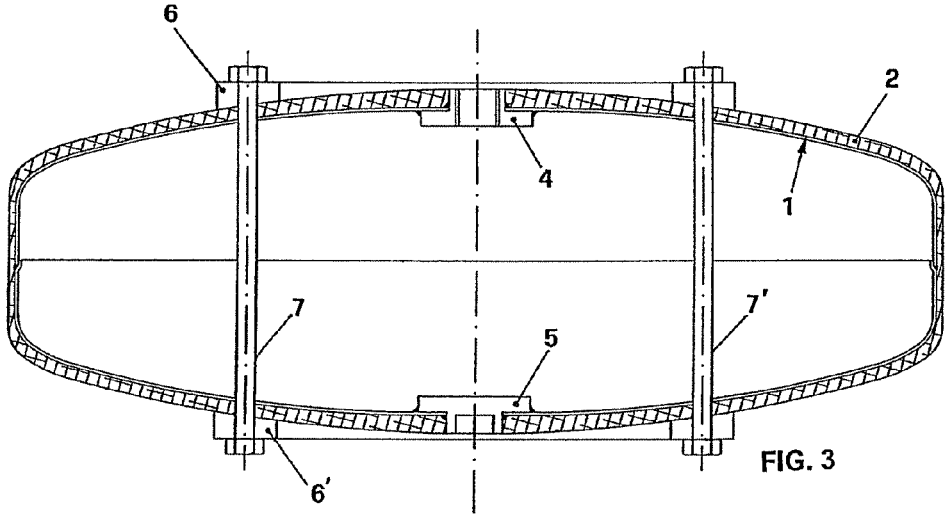
FIG. 3 shows in median section a first executive variant of the invention with a reinforcing structure passing through the tank.
Figure 4:
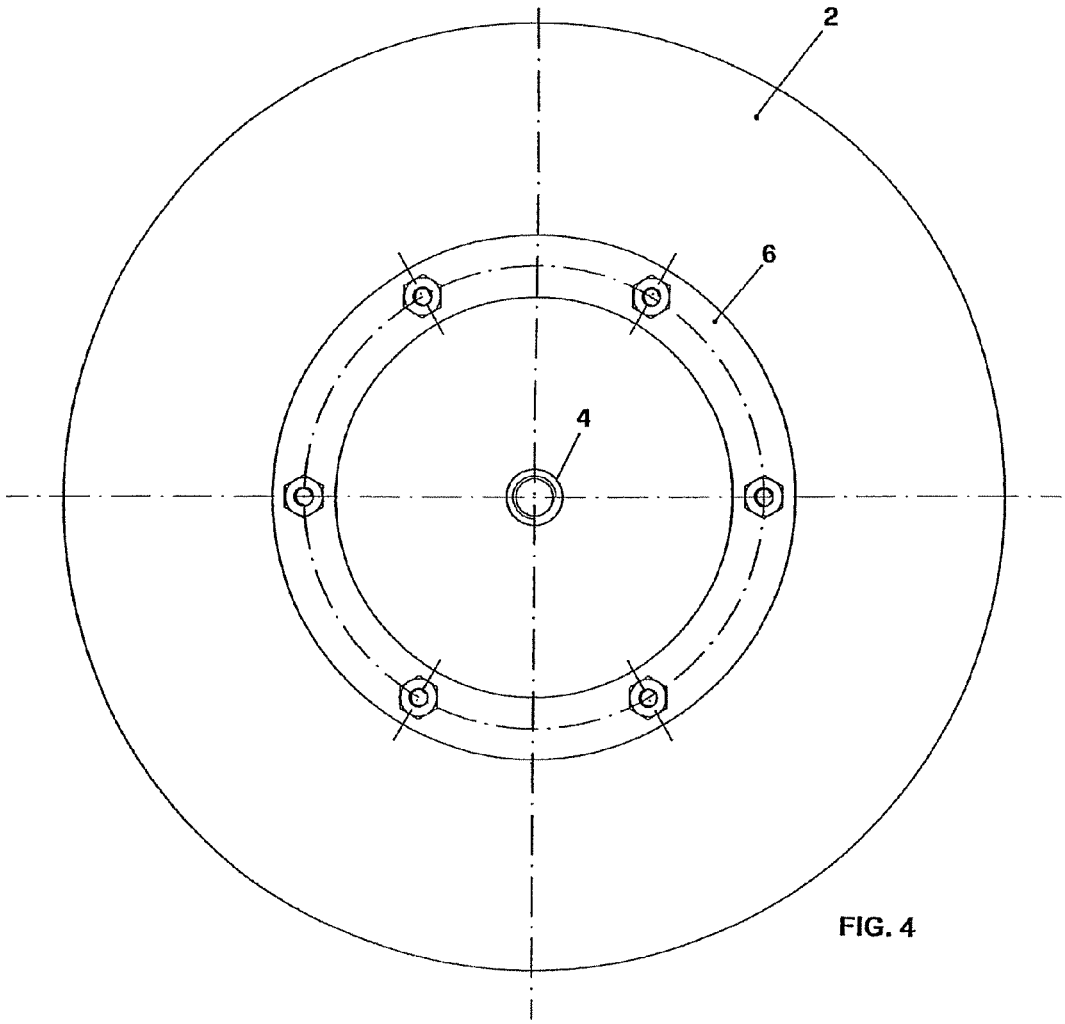
FIG. 4 shows a plan view of the variant of FIG. 3.

FIGS. 3 and 4 represent a first executive variant which includes an external reinforcing structure and which is used on bombé disc tanks having larger diametrical dimensions.

As it can be observed in FIG. 3, the tank is comprised between two central rings 6 and 6' externally in contact with the external coating 2, said rings being mutually connected by a plurality of ties 7 and 7' passing through the core of said tank.

Said central rings 6 and 6' and said plurality of ties 7 and 7' have the evident purpose to guarantee the inalterability of the tank, where the internal high pressure of the stored fluid would act trying to expand the upper and the lower walls.

The dimensioning of the rings and the ties and the decision of the more suitable number of these last ones depend on the tank dimensions and on the pressure of the fluid inserted in it.

FIGS. 5, 7, 9 and 11 are referred to four possible executive variants, still for the tank models having larger dimensions, as an alternative to the solution of FIG. 3.

According to all these last variants each half of the internal core 1 of the tank includes a reinforcing structure inside the said core.

Figure 5:
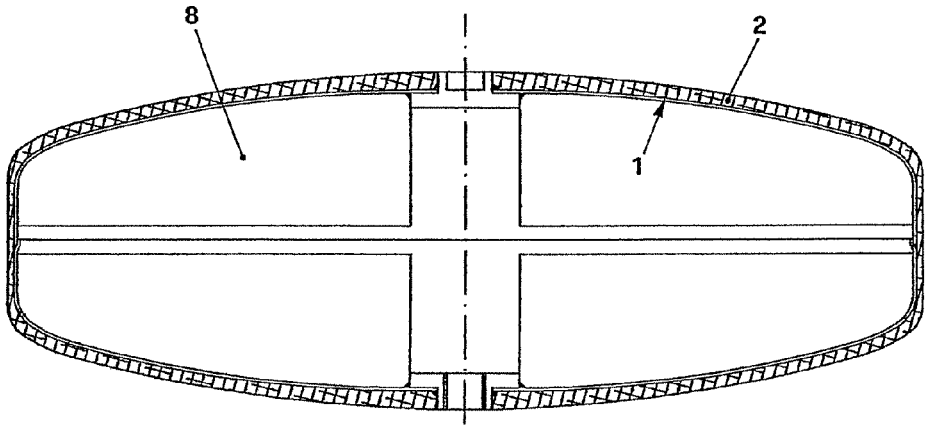
FIG. 5 shows a section of the second executive variant with a reinforcing structure inside the tank.
Figure 6:
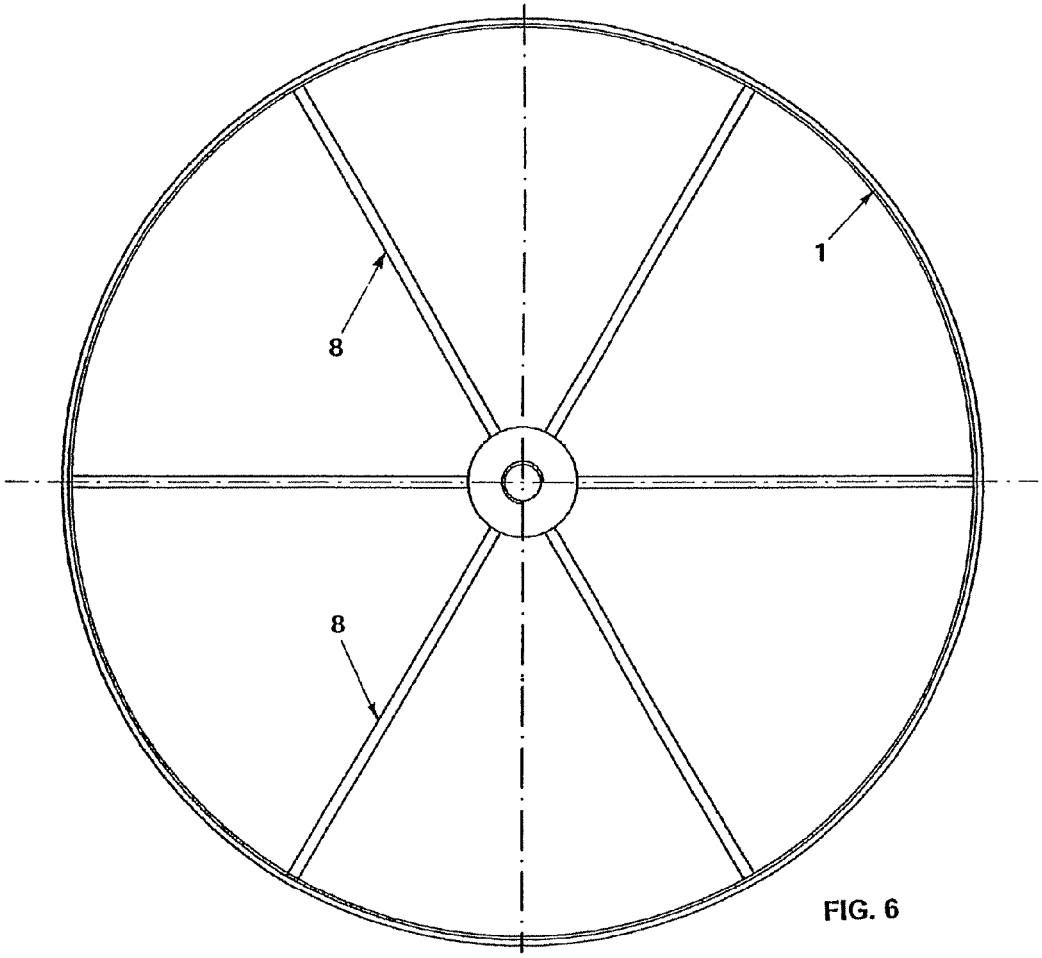
FIG. 6 shows an internal view of the reinforcing structure of FIG. 5.

Particularly, the first reinforcing structure inside the tank's core, shown in FIG. 5 and in FIG. 6, is formed by a plurality of vertical-radial flat elements 8, which are welded in contact with the internal surface of the core 1 following its curving.

Figure 7:
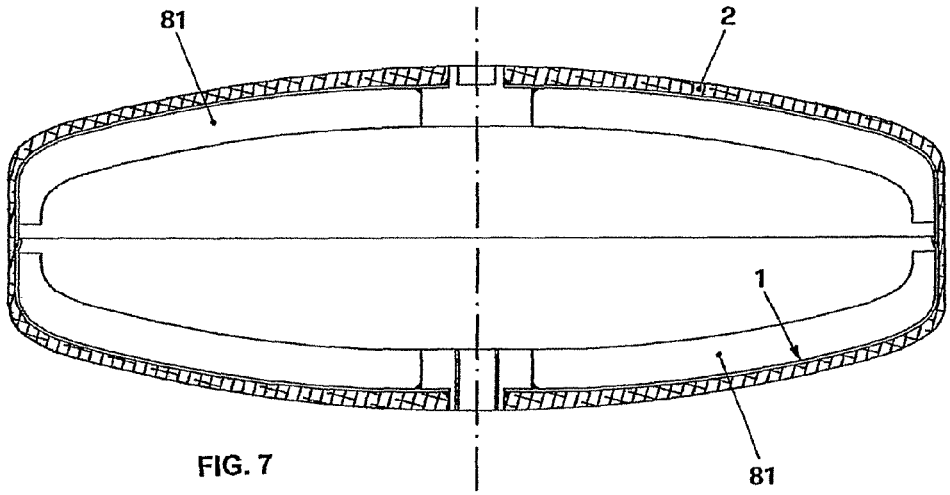
FIG. 7 shows the section of another executive variant of the tank of the invention in spite of a different reinforcing structure inside the tank.
Figure 8:
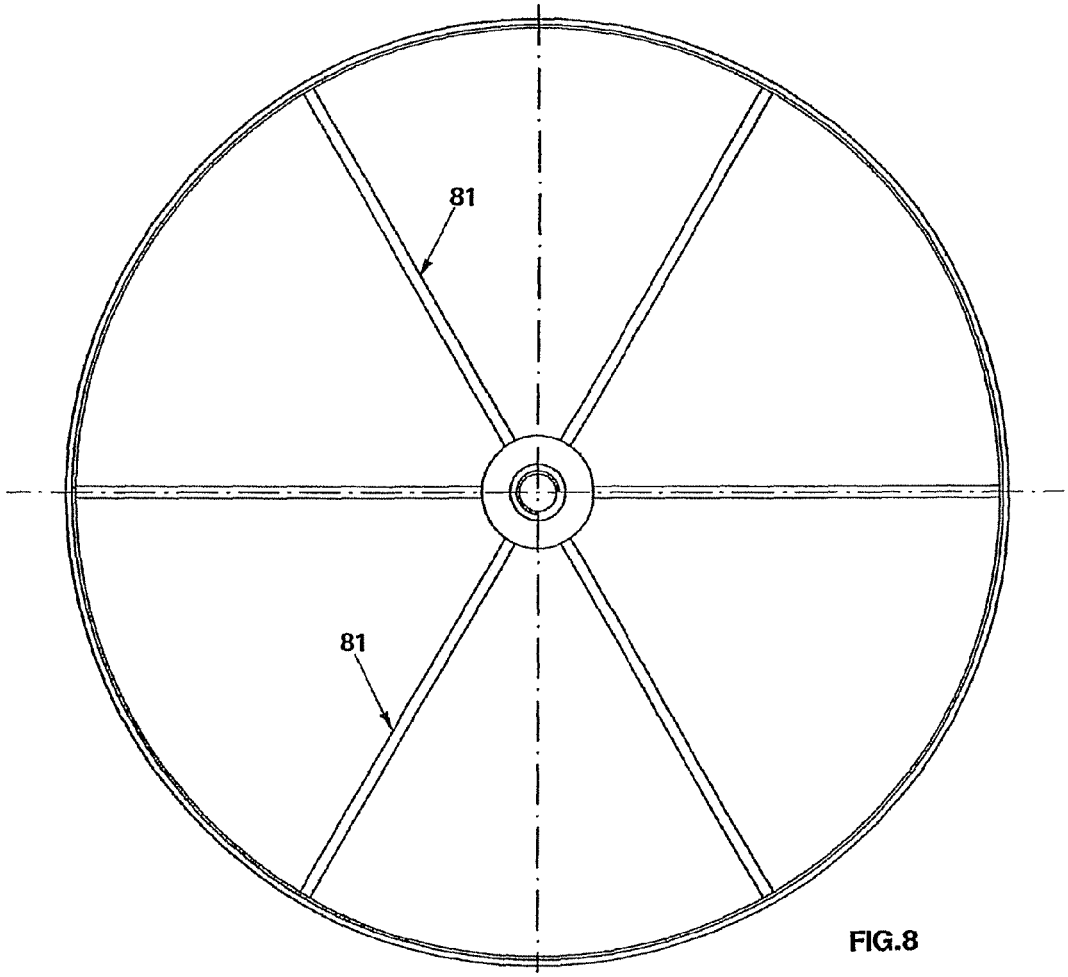
FIG. 8 shows an internal view of the reinforcing structure of FIG. 7.

In FIGS. 7 and 8 another variant of the invented tank is shown where the reinforcing structure is formed by a plurality of vertical-radial flat elements 81, similar to those shown in FIG. 5, but with a reduced height.

Said elements are also welded in contact with the internal surface of the core 1 following its curving.

Figure 9:
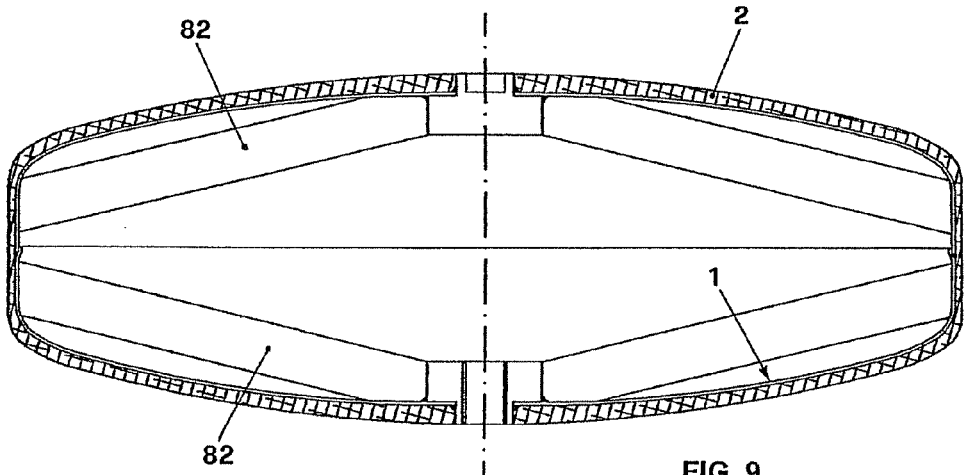
FIG. 9 shows in section an additional executive variant of the tank of the invention with a different reinforcing structure inside the tank.
Figure 10:
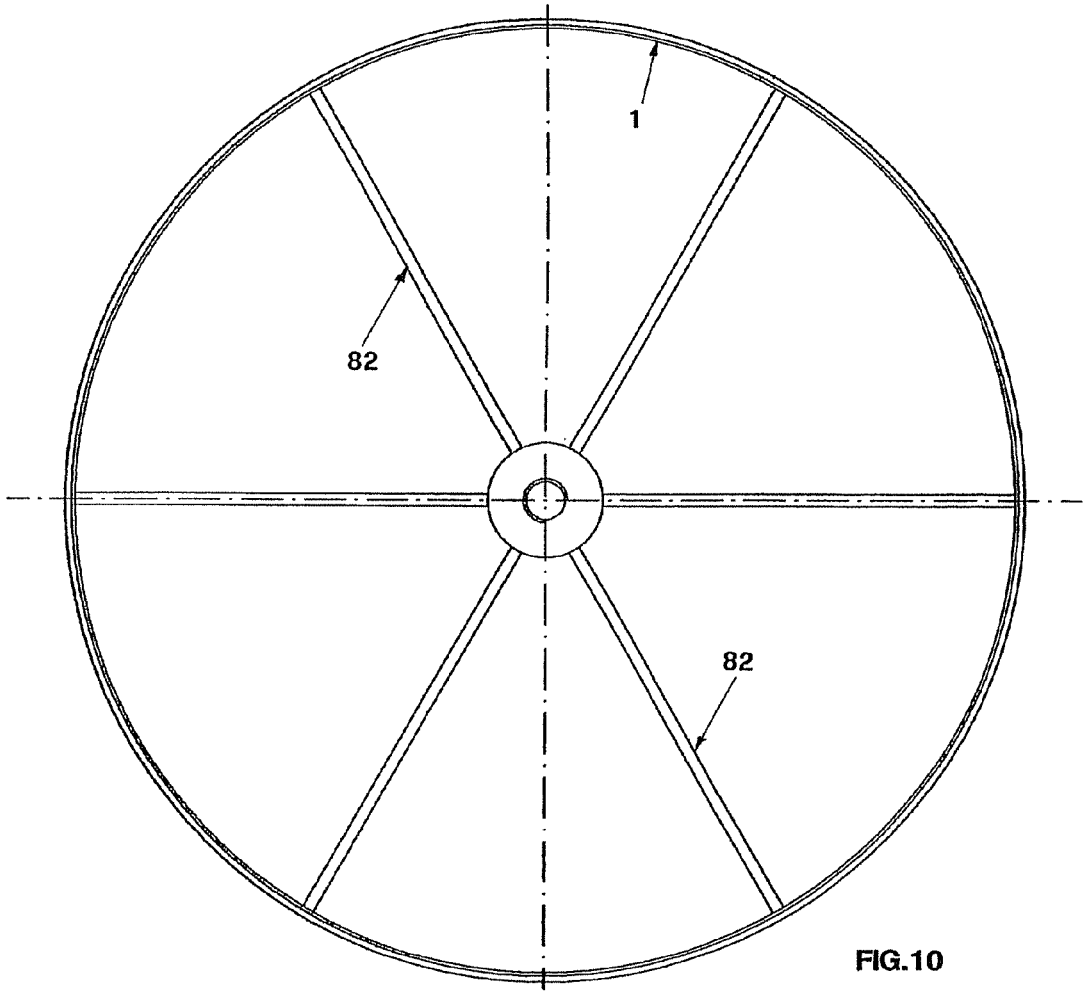
FIG. 10 shows an internal view of the reinforcing structure of FIG. 9.

In FIGS. 9 and 10 an additional variant of the invented tank is shown where the reinforcing structure is formed by a plurality of vertical-radial elements 82, but welded only along single lines in contact with the internal surface of the core 1.

Figure 11:
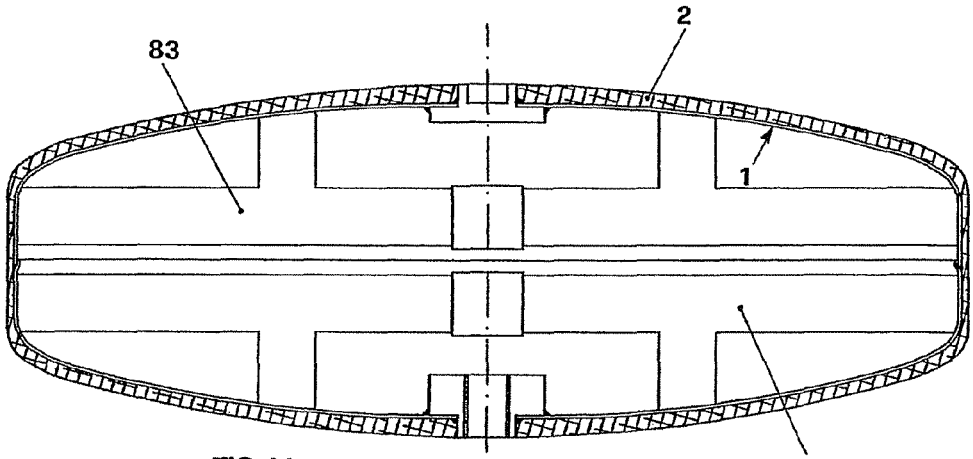
FIG. 11 shows the section of a fifth executive variant with a fourth type of reinforcing structure inside the tank.
Figure 12:
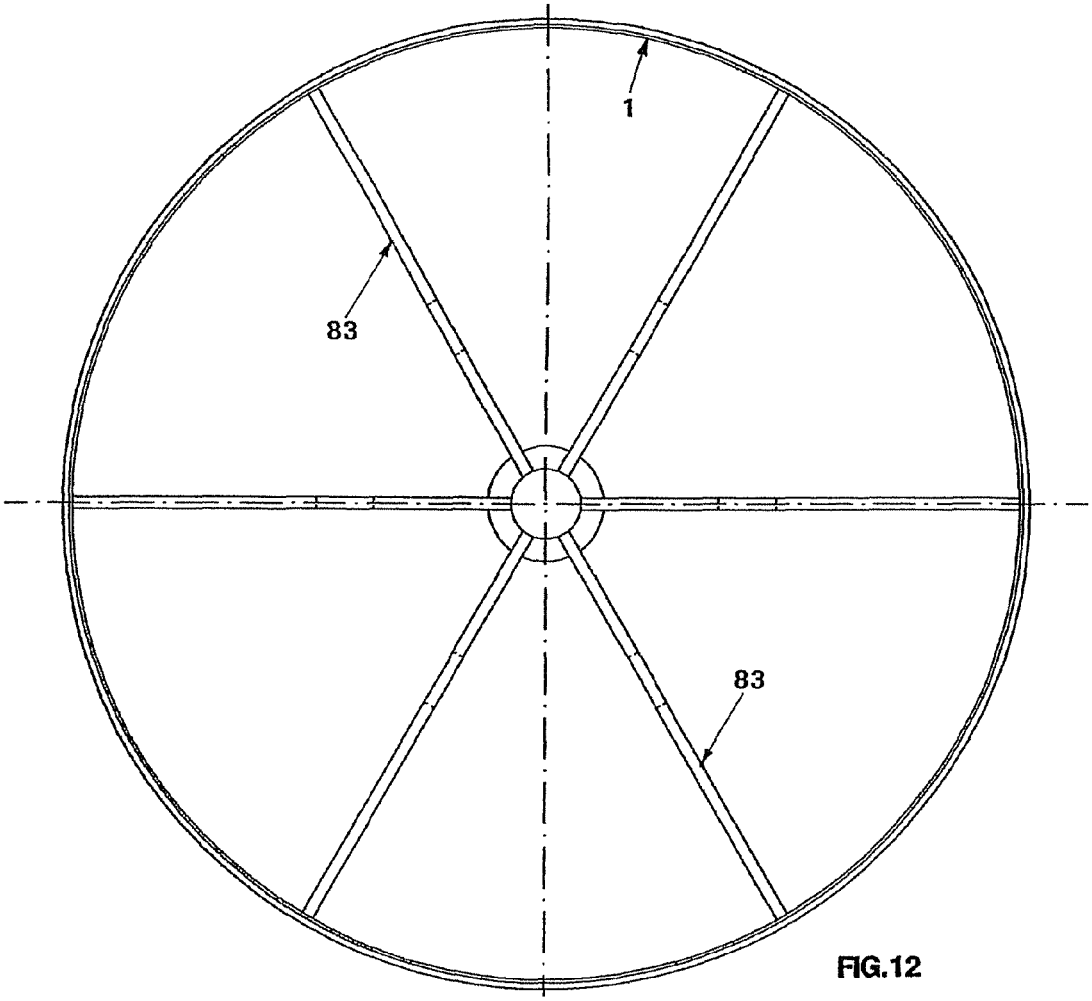
FIG. 12 shows and internal view of the reinforcing structure of FIG. 11.

In FIGS. 11 and 12 another variant of the invented tank is shown where the reinforcing structure is made of a plurality of linear flat elements 83, vertical-radial, welded to the internal surface of the core 1 in connection with some of their vertical appendixes.

Figure 13:
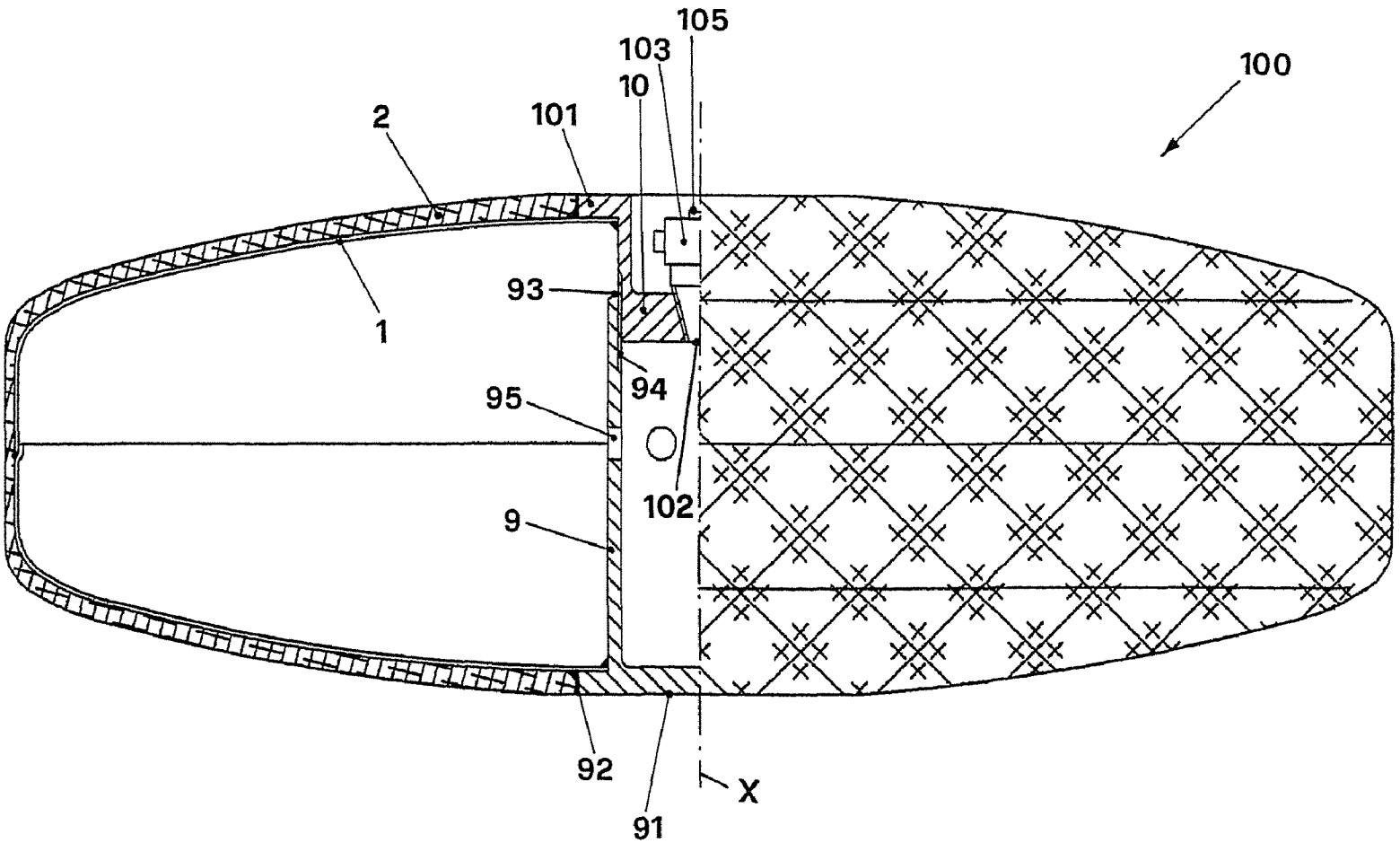
FIG. 13 shows the section of another variant of the tank of the invention where the reinforcing structure of the core consists of a tube centrally located.

FIG. 13 shows in section an additional variant of the invented tank where the internal reinforcing structure of the core 1 is formed by a tube 9 whose axis X is corresponding to the tank's minor symmetry axis.

The tube 9 presents a bottom 91 with an outside diameter 92 larger than the one of tube 9, such as to form a flanged element that is welded to the bottom of the core 1 according to an essentially circular welding.

The tube 9 presents a height lower than the one inside the tank 100 and it ends with an edge 93 which presents an internal threaded line 94 where a plug 10 with an essentially cylindrical shape is screwed on; said plug presents a flanged upper part 101 which is circumferentially and externally welded to the core 1.

Also it must be noted that the tube 9 presents at least a hole 95 that allows the fluid entering the tank through the entrance hole 102 of the plug 10 to flow in the room defined by the core 1.

It is evident that the junction between the tube 9 and the plug 10 realizes a whole piece which is to all intents a high resistance tie preventing the tank's core to deform itself due to the fluid pressure which is settling inside the tank exactly in the weakest area that is really the central part where the tube 9 is located.

Of course, the inlet of the fluid inside the tank takes place through a valve 103 which is fixed by thread into the hole 102 of the plug 10. In a preferred embodiment, hole 102 may be threaded.

The valve 103, which is of the known type, is located inside the cylindrical area defined by the plug 10.

Said valve allows, on one side, the entrance of the fluid for the tank filling and, on the other side, the exit of the same though the entrance 105.

It is important to note that the fact that the plug 10 and the valve 103 are not protruding from the shape of the tank 100 gives an evident advantage for the is economy of the space offered by such a kind of solution, considering that the invented tank is placed in a hollow obtained in the luggage van of a vehicle.

According to all the variants of the invented tank the core 1 is completely wrapped by a resin soaked fiber coating 2, so as to create a compact resistance block all around the volume of the discoid solid forming the tank.

For the just described variants, all including the reinforced internal structure, the choice of the more suitable solution will depend on the tank's dimensions and on the constructive evaluations.

The production range of the invented tank is preferably addressed to the sector of the storage and the use of different kind of compressed gases, particularly of CNG—natural gas—for automotive purposes, typically with a 200 bar working pressure, a 300 bar testing pressure and an over 450 bar bursting pressure.

However, nothing precludes that the tank itself can be usefully used in several different sectors of the mechanics requiring the use of containers for liquids, and not only, having high working pressures, even higher than 450 bar.

Where technical features mentioned in any claim are followed by reference signs, those reference sings have been included for the sole purpose of increasing the intelligibility of the claims and accordingly such reference signs do not have any limiting effect on the interpretation of each element identified by way of example by such reference signs.

The invention claimed is:

1. A tank for high pressure fluids, said tank having an essentially discoid shape, and said tank including;

a sealed core (1);

an external coating (2) to said core realized by a fiber wrapping of composite material with a very high mechanic tensile resistance, said core (1) being formed by two halves (11, 12) opposite and mutually joined along a contact circumference (3), characterized in that said core (1) is connected to a reinforcing structure placed inside said core (1), said reinforcing structure being formed by a tube (9) provided with at least one hole (95) communicating with an interior of said tank and having an axis of said tube coinciding with a tank minor axis of symmetry, said tube being joined to a plug (10) with an essentially cylindrical shape, said plug (10) not protruding from a profile of said tank.

2. A tank according to claim 1, characterized in that said plug (10) presents a threaded hole (102) housing a valve (103) for filling said tank with said high pressure fluid, said valve (103) not protruding from a profile of said plug (10).

3. A tank according to claim 1, characterized in that said external coating (2) totally covers said core (1).

4. A tank according to claim 1, characterized in that said wrapping forming said external coating (2) is made of carbon fiber stratified and soaked with resins suitable to give compactness and stability to said wrapping.

5. A tank according to claim 1, characterized in that said tube (9) and said plug (10) are joined together by screwing.

6. A tank according to claim 2, characterized in that said tube (9) and said plug (10) are joined together by screwing.

7. A tank according to claim 1, characterized in that said tube (9) presents a bottom (91) with a flanged element (92) and in that said plug (10) presents a flanged upper part (101), said flanged element (92) and said flanged upper part (101) being welded to said core (1).

8. A tank according to claim 2, characterized in that said tube (9) presents a bottom (91) with a flanged element (92) and in that said plug (10) presents a flanged upper part (101), said flanged element (92) and said flanged upper part (101) being welded to said core (1).

9. A tank according to claim 5, characterized in that said tube (9) presents a bottom (91) with a flanged element (92) and in that said plug (10) presents a flanged upper part (101), said flanged element (92) and said flanged upper part (101) being welded to said core (1).

10. A tank according to claim 6, characterized in that said tube (9) presents a bottom (91) with a flanged element (92) and in that said plug (10) presents a flanged upper part (101), said flanged element (92) and said flanged upper part (101) being welded to said core (1).

11. A tank according to any one of claim 1, 2, or 5-10 inclusive, further characterized in that the a section containing the two symmetry axis axes of said discoid shape has a substantially elliptic shape with said minor axis equal or shorter than half of the major axis.

* * * * *